US005938333A

United States Patent [19]

Kearney

[11] Patent Number: 5,938,333

[45] Date of Patent: Aug. 17, 1999

[54] FRACTAL CASCADE AS AN ALTERNATIVE TO INTER-FLUID TURBULENCE

[75] Inventor: Michael M. Kearney, Twin Falls, Id.

[73] Assignee: Amalgamated Research, Inc., Twin Falls, Id.

[21] Appl. No.: 08/726,393

[22] Filed: Oct. 4, 1996

[51] Int. Cl.[6] ..... B01F 5/00

[52] U.S. Cl. ..... 366/336; 138/42

[58] Field of Search ..... 366/336, 337, 366/338, 339, 340, 349, 342, 174.1, 341, 183.1; 137/625.28, 599; 138/40, 42; 165/109.1, 159, 172, 296, 100, 102

[56] References Cited

U.S. PATENT DOCUMENTS

| | | | |
|---|---|---|---|
| 2,094,948 | 10/1937 | Hurley et al. | 366/336 |
| 3,195,865 | 7/1965 | Harder | 366/337 |
| 4,019,721 | 4/1977 | Langner . | |
| 4,198,168 | 4/1980 | Penn | 366/366 |
| 4,999,102 | 3/1991 | Cox et al. . | |
| 5,094,788 | 3/1992 | Schrenk et al. | 366/340 |
| 5,307,830 | 5/1994 | Walker . | |
| 5,354,460 | 10/1994 | Kearney et al. . | |
| 5,637,469 | 6/1997 | Wilding et al. | 435/7.21 |

OTHER PUBLICATIONS

Ary L. Goldberger et al.; "Chaos and Fractals in Human Physiology"; Scientific American; Feb. 1990; pp. 43–49.

*Primary Examiner*—Tony G. Soohoo
*Attorney, Agent, or Firm*—Trask, Britt & Rossa

[57] ABSTRACT

An artificial eddy cascade structure, useful as a fluid input and/or fluid collection device with respect to a contained volume of fluid, is provided as a fractal construct of recursively smaller fluid conduits of recursively greater number, whose terminal points fill the contained volume with a high degree of density. The cascade structure functions as an alternative to, or avoidance of, the inter-fluid turbulence normally associated with fluid transport, mixing, distribution and collection operations.

17 Claims, 7 Drawing Sheets

FRACTAL CASCADE AS AN ALTERNATIVE TO INTER-FLUID TURBULENCE

BACKGROUND OF THE INVENTION

1. Field

This invention relates to the mixing of fluids, and is specifically directed to mixing techniques which minimize turbulence. It provides a recursive cascade conduit structure.

2. State of the Art

Turbulence is one of the most important phenomena of fluid motion. Most kinds of fluid flow are turbulent; common examples including process mixing, river flow, fluid jet streams, atmospheric and ocean currents, pump flow, plumes and the wakes of ships. Turbulence is characterized by the development of eddy cascades. The term "cascade" is used in this disclosure to characterize the flow of fluids through a series of regions, progressing from higher to lower energy levels. Within eddy cascades, currents bring about rapid fluctuations within a space and during a time interval, of the physical properties of a fluid. A characteristic of turbulence is the flow of energy from larger to smaller spatial scales. Energy is passed down the eddy cascade to smaller and smaller eddies until the inherent viscosity of the fluid causes dissipation of the energy as heat.

Turbulence is relied upon for a wide range of processes. These processes include heat and mass transfer, fluid distribution and mixing. While useful for such practical applications, turbulence also imposes some limitations and negative characteristics upon the commercial processes in which it exists.

Turbulence is ubiquitous in mixing operations. Molecular diffusion is a very slow process of limited application. "Stretch and fold" techniques are used to mix very high viscosity materials, but have little other practical application. Almost all other forms of mixing involve some form of induced turbulence. Most commonly, mechanical interaction is employed to create a desired level of agitation. Devices for mixing include propeller and stirring devices, aerators, shaking devices, blenders and pumps. Other devices rely upon various configurations of fluid jets, baffles or impinging structures to induce turbulence. Alternatively, the fluids to be mixed may be passed through an apparatus of the type referred to as a "motionless" or "static" mixer. Such devices are static with respect to their structure, but have internal elements arranged to cause inter-fluid turbulence.

Non-turbulent mixing devices are very uncommon, being inconsistent with common experience. U.S. Pat. No. 4,019,721 discloses a mixer characterized as "non-turbulent." The apparatus of that patent operates by passing fluids upwardly into a chamber containing a heavy ball. The disclosure acknowledges that turbulence is probably induced in the fluid on the downstream side of the ball, in addition to other poorly understood non-turbulent mixing effects as the fluid flows around the ball.

Fluid mixing is regarded as a turbulent process, and the efficiency of mixing is regarded as a function of the severity of the turbulence. It is commonly understood that mixing improves as turbulence is heightened. Heightened turbulence is accomplished, for example, by increasing mixer blade speed (increased rpm), shaking fluids more violently, stirring faster, adding turbulence causing baffles and equivalent expedients for adding energy to the fluids.

"Sorption processes" involve the contacting of a fluid stream with a fixed bed of solid particles. In such operations, a solid sorption material is surrounded with a fluid which moves through the voids around and/or within the solid particles. The usual configuration of a sorption process includes columns filled with the solid sorption material. The fluid to be treated is passed either upflow or downflow through the column. A key characteristic of such processes is that entering fluid passes into and through the bed as a moving cross section. Fluid distributors are used to introduce fluid into and collect fluid from the column on an intermittent or continuous basis. U.S. Pat. Nos. 4,999,102, and 5,354,460 disclose recent examples of industrial fluid distributor designs which claim a uniform distribution/collection over a cross sectional area of a column. The goal of these and other similar devices is to distribute and/or collect a two dimensional surface of fluid.

A common approach to rapidly distributing an entire volume of fluid within a bed of sorption material is to induce energetic turbulent mixing. For example, liquid can be added to a bed of solid particles while vigorously stirring or blending the fluid and solid together. While such a turbulent process does accomplish the goal of rapid volume mixing, it also imposes several undesirable consequences. For example, turbulence under these circumstances eliminates the possibility of efficient packed bed operation, because the bed is fluidized. Mechanical attrition of the solid bed particles is inevitably increased. Additionally, if such a process is operated in a continuous manner, there results a ceaseless intermixing of entering untreated material and treated material which would otherwise be suitable for exiting the system. These undesirable features associated with fluidization are avoided by the conventionally preferred method of flowing fluid up or down a packed column under non-turbulent flow conditions.

U.S. Pat. No. 5,307,830 describes a method for reducing turbulence downstream of a partially open or closed valve element. The device comprises a group of identically sized tubes to smooth the turbulence and distribute the resulting fluid to a cross sectional area, rather than to a volume.

It is well known that three dimensional fractal structures of conduit exist in nature. For example, the blood vessels of the heart and the airways of the lung exhibit fractal architecture. The usefulness of this evolved architecture is recognized to include the ability to provide distribution and collection of fluids to the cells of the body (blood vessels) and present a large surface area for gas exchange (lungs). It has not been recognized that such structures can be used as a useful alternative to inter-fluid turbulence. Furthermore, no method has previously been disclosed which describes procedures to design and make practical use of devices of this type.

There remains a need for a device or system which can effect excellent mixing without the disadvantages associated with turbulence.

SUMMARY

This invention comprises the use of fluid conduits arranged as space-filling fractal structures. An artificial eddy cascade functions as a substitute for inter-fluid turbulence for events which normally exhibit or require inter-fluid turbulence. This invention reduces the wide range of spatial scales over which the structure and dynamics of inter-fluid turbulence occur. This reduction is accomplished by passing a given fluid through an artificial eddy cascade structure of fluid conduits.

The present invention provides a structural configuration and approach which effectively mixes fluids in a very gentle manner. Notably, a fractal cascade of conduits replaces the free eddy cascade characteristic of inter-fluid turbulence. According to this invention, a first fluid is distributed by direct injection throughout the volume of a second fluid. Fluids can thus be mixed without inducing the complicated fluctuations caused by turbulent mixing equipment. The apparatus of this invention also permits localized mixing within a volume. It is possible to mix a first fluid component within a small fraction of the volume of a second fluid component. This ability of localized mixing is not achievable under turbulent mixing conditions, especially if the mixing is rapid.

Unlike conventional "static" mixers, the apparatus of this invention can actually be operated in a manner which causes little inter-fluid turbulence. An unexpected characteristic of this invention is that the efficiency of mixing increases as inter-fluid turbulence decreases. This characteristic is believed to be entirely contradictory to accepted mixing principles.

Generally, the apparatus of this invention comprises a construct of recursively smaller fluid conduits of recursively greater number. This construction results in decreasing turbulence as fluid passes through the structure. As a result, fluid passing down through the cascade experiences the spatial scaling effect which is normally associated with the eddy cascade of turbulence. Large scale fluid motion is recursively divided into smaller and smaller units of visible physical motion. Moreover, the apparatus comprises a multiple conduit assembly, of which the conduit outlets are arranged to effect a space filling distribution. As a result, the scaled-down fluid exiting the structure experiences the distribution or mixing effect normally associated with the eddy cascade of turbulence. The exiting fluid is interspersed throughout the volume of a contained fluid into which the device is placed.

The apparatus of this invention may also function as a fluid collector. With the fluid flow direction reversed, each outlet in the system functions as a collection orifice. A fluid can thus be collected from a volume and passed up the cascade. Using the device in this fashion provides a means for collecting fluid from throughout a volume in an approximately homogeneous manner. As a result of its space filling characteristic, the apparatus delivers and/or collects a three dimensional volume of fluid.

An important technique in the layout of specific embodiments of this invention is the use of fractal geometry. Fractal structures are mathematical constructs which exhibit scale invariance. In such structures a self similar geometry recurs at many scales. Although fractal structure is not a necessity for implementing this invention, its use is favored to expedite the design process, and to provide a deep and flexible scaling capability. Fractal geometry applied to this invention allows a designer easily to layout a desired density of space filling points appropriate for a given application. A suitable design approach involves adding scaled-down versions of an "initiator". As scaled-down structures are added, the density of the terminal points increases. As the grid of terminal points becomes more dense, the mixing effect is increased. At the same time, the inter-fluid turbulence is decreased.

As a result of its scale-down and volume distribution characteristics, this device can be used for either reduced turbulence mixing and/or turbulence dampening. Use of multiple devices for inflow and outflow from a volume provides for continuous low turbulence volume fluid distribution and collection.

The basic structural unit of this invention may be viewed as an initiator conduit structure, including an initiator inlet in open communication with a first generation set of distribution conduits, each of which terminates in one of a set of first generation outlets. The first generation outlets comprise a first population located on a first side of a first generation reference plane and a second population located on a second side of the first generation reference plane. In the simplest version currently contemplated, the first generation (initiator) inlet communicates with a hub, and the first generation distribution conduits radiate as spokes from the hub, ideally as four hydraulically similar legs. Assuming a symmetrical construction, the first generation outlets are positioned at approximately the eight corners of an imaginary cube.

A second generation set of conduit structures of reduced scale compared to the first generation conduit structure is connected structurally and in fluid flow relation to the first generation outlets. The second generation set typically has approximately identical members equal in number to the number of outlets in the set of first generation outlets. Each member of the second generation set of conduit structures mimics, but to a smaller, typically 50%, scale, the structural configuration of the initiator. Accordingly, each such member includes a second generation inlet in open communication between one of the first generation outlets and a second generation set of distribution conduits, each of which terminates in one of a set of second generation outlets.

The second generation outlets associated with each member of the set of second generation conduit structures also comprises a first population located on a first side of a second generation reference plane, spaced from and approximately parallel the first generation reference plane and a second population located on a second side of the same second generation reference plane. Each second generation member must be visualized with respect to its individual second generation reference plane, although some of these planes may be congruent. Following the pattern of four legs and eight outlets, the second generation outlets of each second generation member will also be positioned at the respective corners of respective imaginary cubes.

A completed assembly of this invention may be viewed as a fluid scaling cascade of branching conduits. The cascade necessarily includes a largest scale conduit at a first, or large scale, end of the cascade and a plurality of smallest scale conduits at a second, or small scale, end of the cascade. Of course, the small scale end of the cascade will be distributed throughout the volume occupied by the cascade structure. The largest scale conduit will be connected by successive divisions at corresponding successive branches to the smallest scale conduits. Fluid flowing through the cascade from the large scale end to the small scale end of the cascade is progressively scaled into smaller units of flow, so that fluid flowing through the cascade in that direction eventually exits approximately homogeneously into the volume containing the cascade. Fluid flowing through the cascade from the small scale end to the large scale end of the cascade is progressively scaled into larger units of flow, whereby to collect fluid approximately homogeneously from the volume containing the cascade through the small scale end, eventually to exit from the large scale end.

The largest scale conduit is connected to the smallest scale conduits through a succession of conduits of decreasing scale corresponding to a plurality of descendent generations of progressively decreasing scale. Ideally, each generation of branching conduits is scaled to contain approximately the same volume of fluid as each other generation of conduits in the cascade.

A fundamental benefit of this invention is its ability to replace instances of inter-fluid turbulence with a space-filling, turbulence reducing device. Application of this device as a substitute for the mixing in a conventional turbulent bed, for example, results in a number of unexpected advantages. For this application, the device is operated as a volume distribution/collection pair. Because the fluid to be treated can be mixed with the fluid surrounding the solid sorption material with reduced turbulence, the bed is not disturbed. The bed can remain packed, and continuous turbulence-induced mixing of treated and untreated material is reduced. Use of the entire volume of the bed material thus becomes practical, without the disadvantages routinely experienced under turbulent mixing conditions.

With respect to conventional column flow methods, use of the device of this invention avoids passing the fluid through the entire length of a bed. As a result, bed pressure drop is reduced to only the path length between corresponding distribution and collection points. This modification reduces pressure drop-dependent energy requirements and avoids much of the expense and materials associated with high pressure column design. The low pressure drop also permits the use of sorption material of much smaller particle size than is normally required by a column flow operation. In most instances, a smaller particle size will result in faster kinetics of sorption because the surface area of the sorption material increases as size decreases. Faster kinetics also permit smaller equipment size, because more material can be treated in a shorter period of time. It has not heretofore been contemplated to substitute space filling, low turbulence devices for the conventional surface distributors or turbulent bed mixing methods used for sorption processes. The device of this invention has many other practical applications in which it can replace components normally present in flow through columns. For example, cross-sectional type distributor/collectors can be replaced with the volume distributor/collectors of this invention.

This invention is generally useful to modify processes involving fluid flowing quickly past an obstacle or a fluid jet entering a stationary fluid. Under turbulent conditions, such processes give rise to the presence of turbulent eddies in the fluid and, as a consequence, uncontrollable fluctuations in physical characteristics result at many scales of measurement. This invention makes it possible quickly to disperse moving fluid throughout a volume of a second fluid in a homogeneous manner and with reduced turbulent disturbance. The usual irregular large scale inter-fluid eddy effects are reduced. Consequently this device can be used to reduce turbulent fluctuations in physical characteristics downstream from a turbulent source. The turbulence normally caused by a fluid jet, instrument noise, pluming or wake sources can be suppressed in a controlled manner.

BRIEF DESCRIPTION OF THE DRAWINGS

FIG. 7 consists of:

DETAILED DESCRIPTION OF THE ILLUSTRATED EMBODIMENT

Figure 1:
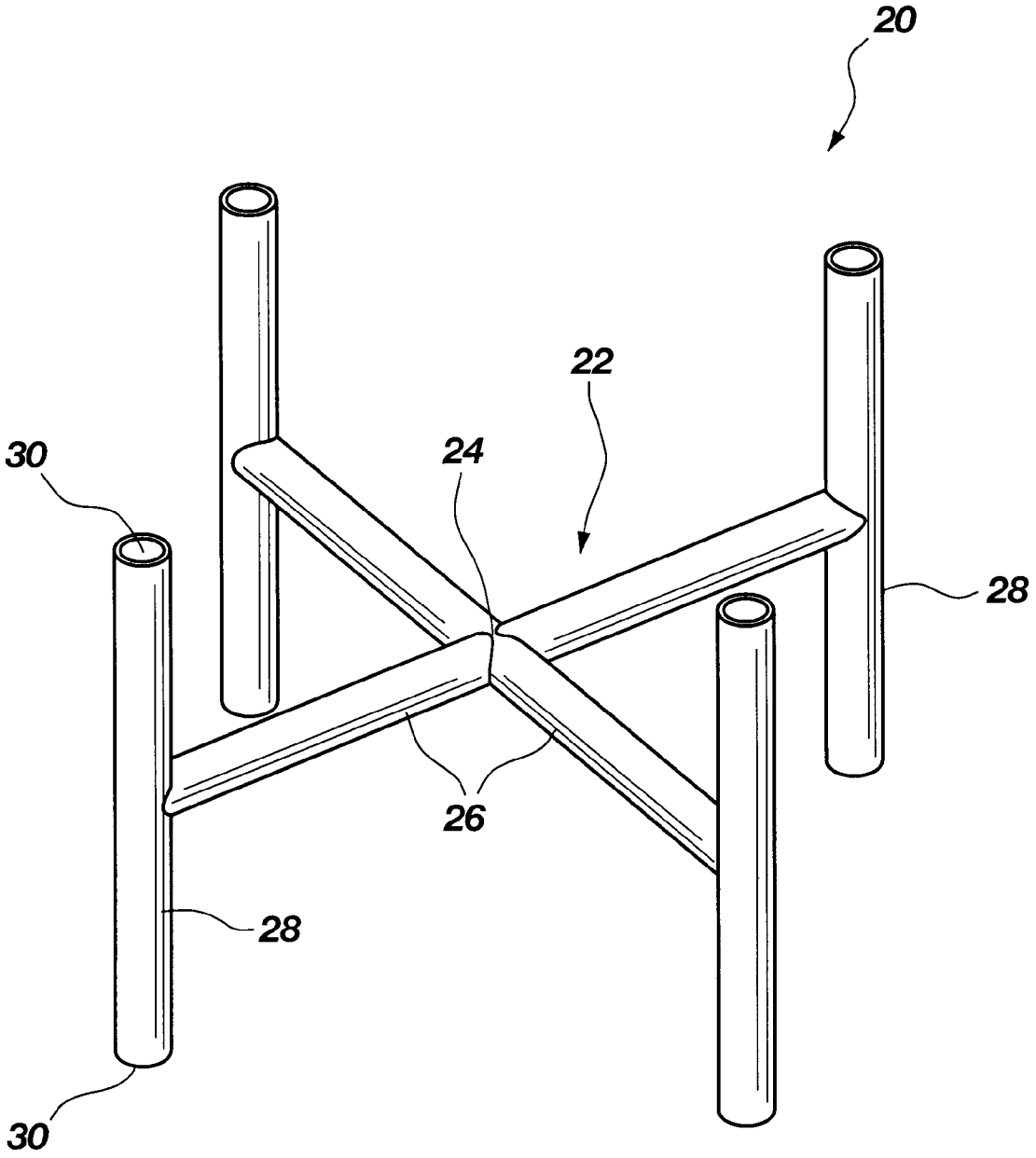
FIG. 1 is an isometric view of an artificial eddy cascade pattern initiator constructed of conduit.
Figure 2:
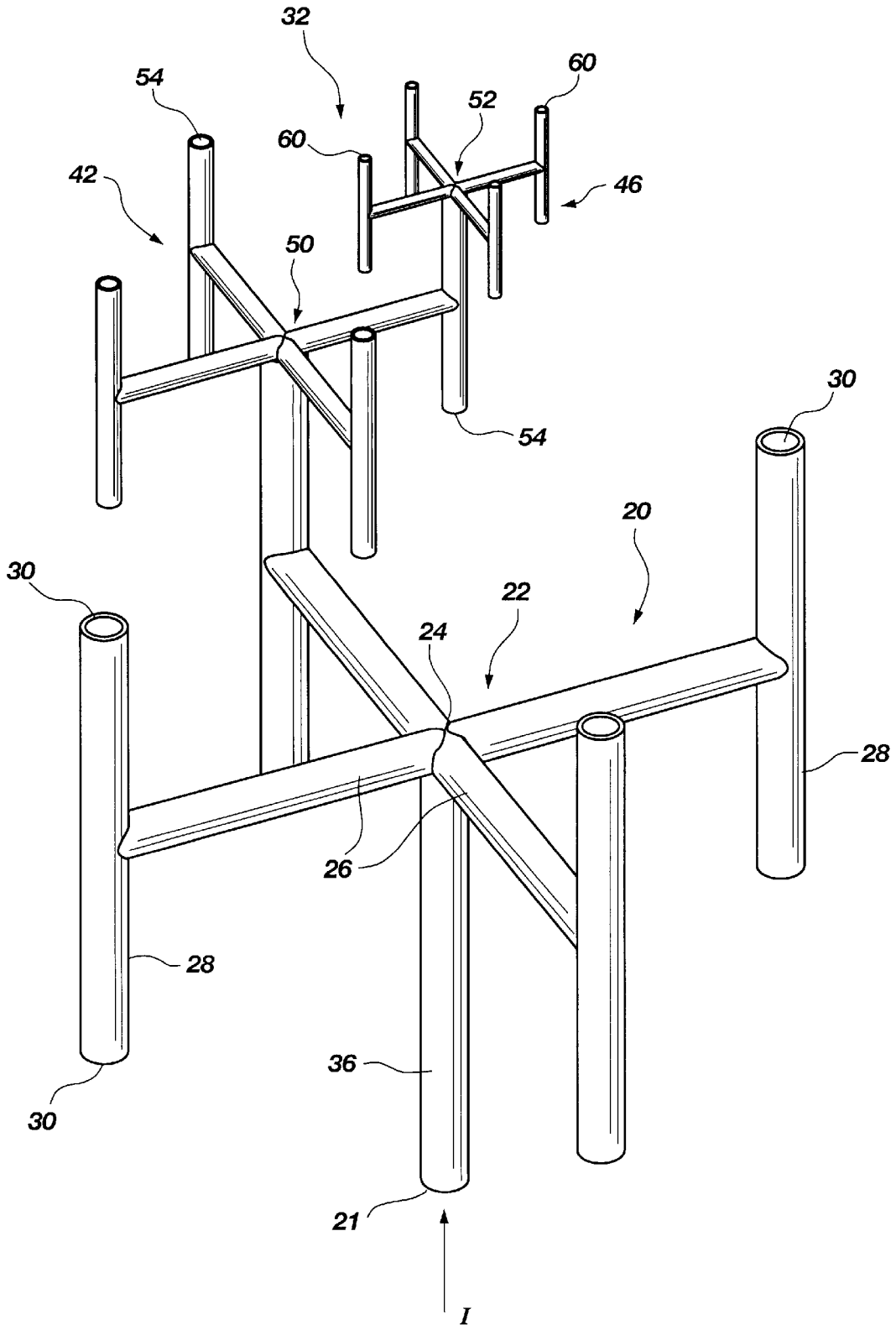
FIG. 2 is an isometric view illustrating a partially constructed artificial eddy cascade with three scales of a fractal pattern constructed along one path.
Figure 3:
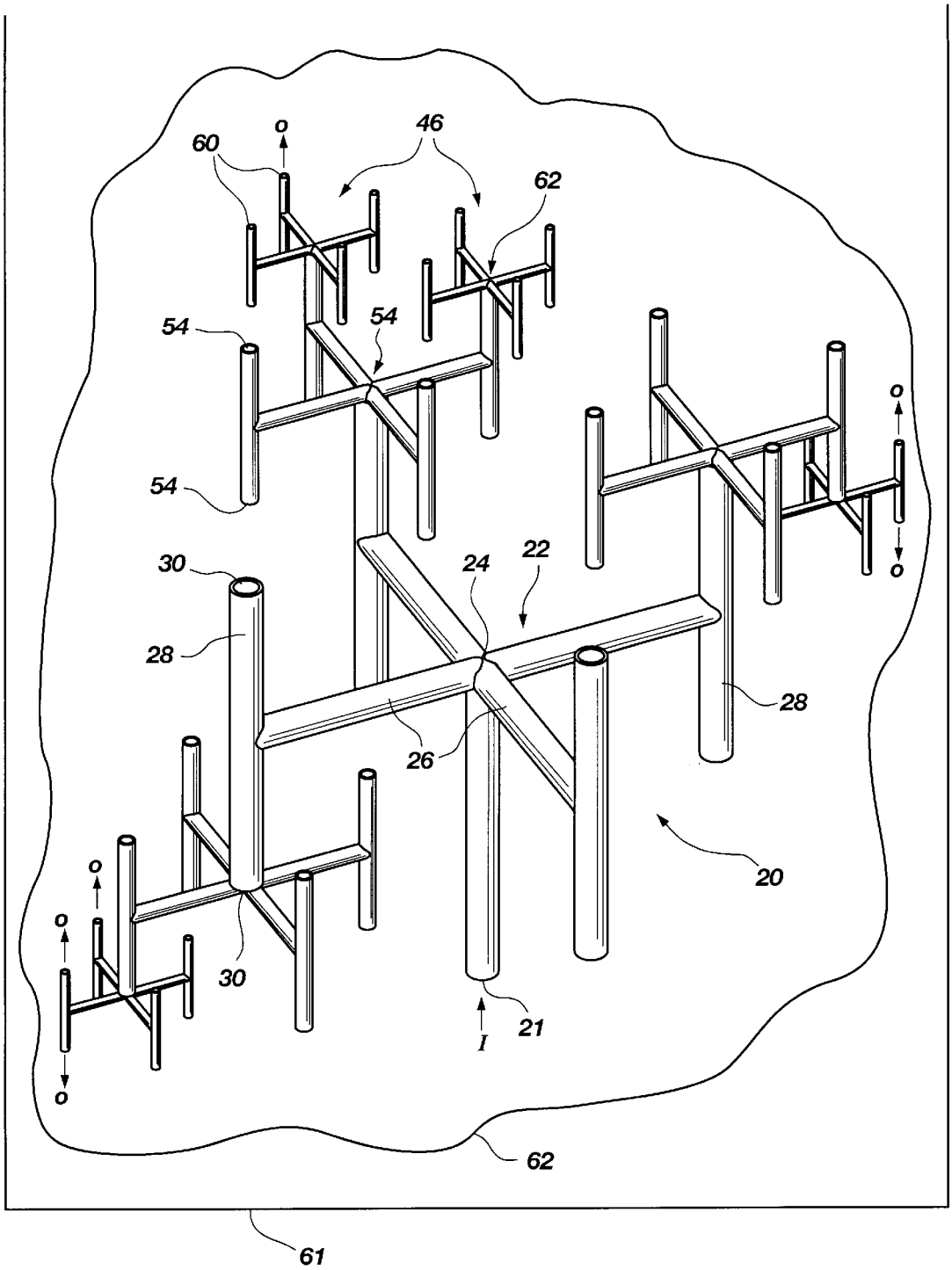
FIG. 3 is an isometric view of the continuing construction of the artificial eddy cascade depicted by FIG. 2.
Figure 4:
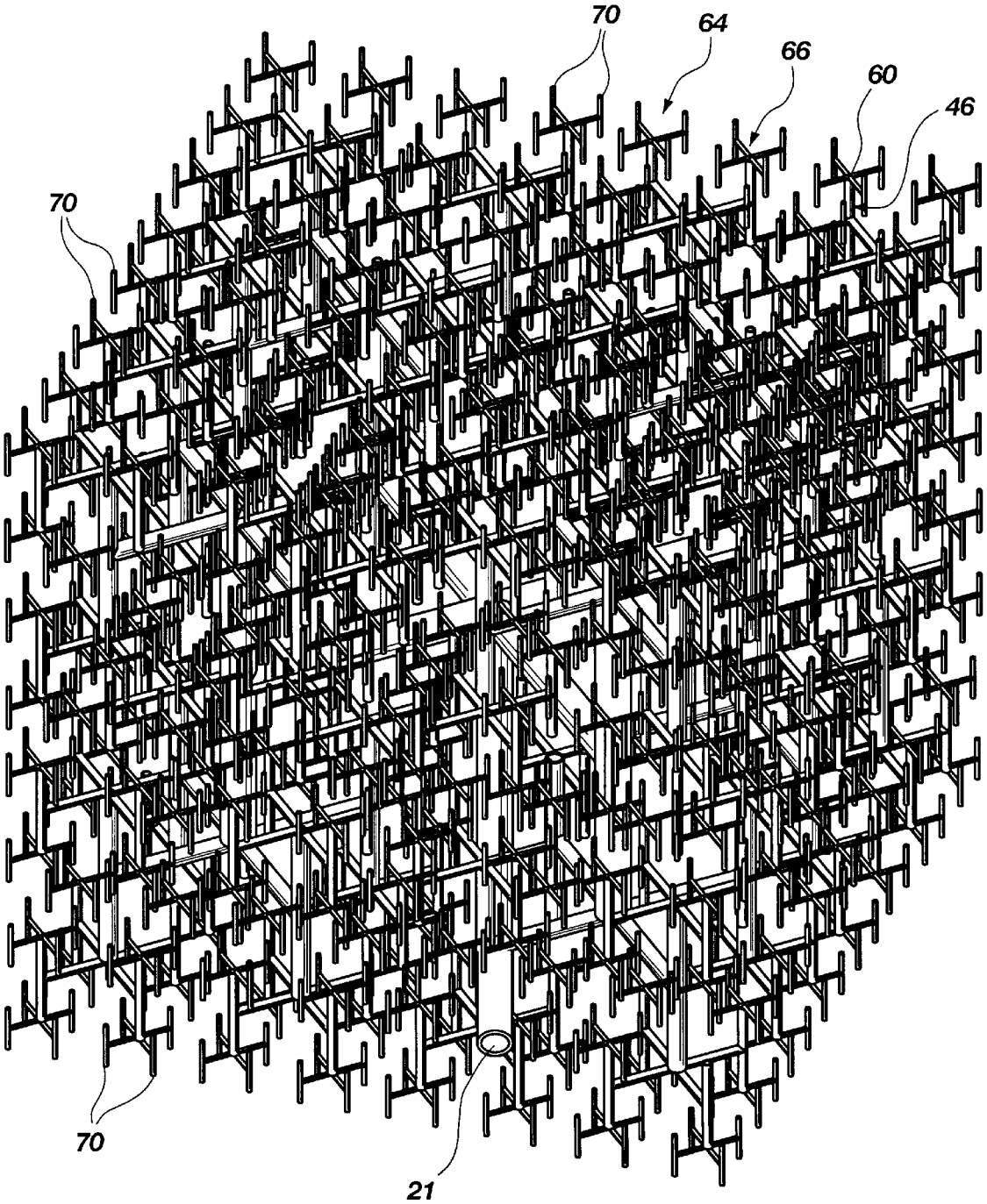
FIG. 4 is an isometric view of a completed artificial eddy cascade with a total of four scales of a fractal pattern.

A presently preferred artificial eddy cascade initiator 20 is illustrated by FIG. 1. FIGS. 2, 3 and 4 illustrate the progressive construction of a cascade device patterned on this initiator 20. On a macro scale, relative to a cascade device, the term "inlet" is used consistently in this disclosure to denote the entrance (21, FIG. 2) to the single largest diameter conduit attached to a cascade device and the term "outlets" denotes the high count smallest diameter conduits of the cascade. It should be recognized, however that if the cascade device is used for fluid collection, these two designations would more properly be reversed. The structure is described in this disclosure with principal emphasis on its use as an input device. A "cascade device" is considered to constitute an assembly of recursive generations of cascade initiators, each cascade initiator possessing an inlet and multiple outlets. On a micro scale, such a device includes multiple inlets and outlets communicating between generations of cascade initiators. The outlets of the final generation of cascade initiators comprise the "outlets" of the cascade device.

The initiator conduit structure, generally designated 20, is constructed of conduit, which may be of any convenient cross-sectional configuration. As illustrated, an internally open crossbar conduit, designated generally 22, is constructed from circular cylindrical metal or plastic conduit. The materials of construction for this invention will ordinarily be selected to satisfy the requirements of a particular application, but are ordinarily of secondary importance. The crossbar conduit 22 may be considered to comprise a central hub 24, and a plurality of radiating spokes 26. While other hub and spoke configurations are within contemplation, the simple "cross" configuration illustrated is generally preferred, and offers sufficient cascade capabilities for most applications.

The crossbar conduit 22 has four spokes 26, each of which terminates in open communication with the internal volume of a respective leg 28. The legs 28 are also formed of conduit, and terminate at opposite ends in outlets 30. As illustrated, the outlets 30 of the conduit legs 28 are positioned at the eight corners of a cube, although other configurations are operable. Fluid is free to flow from the hub 24 of the crossbar conduit 22 to any outlet 30. The initiator is constructed such that the hydraulic path characteristics from the crossbar center hub 24 to each termination end 30 are approximately equivalent.

Legs 28 and crossbar 22 are illustrated as having equivalent conduit diameter. Other embodiments may incorporate a decrease in conduit diameter from the crossbar conduit 22 to the legs 28. Although the various angle turns in the initiator structure 20 are illustrated as 90 degree bends, it is equally valid to provide smoothly turned conduit bends.

FIG. 2 illustrates the manner in which scaled down versions of the initiator 22 illustrated by FIG. 1 are assembled into a cascade arrangement, generally 32. A transfer conduit 36 is openly connected to the crossbar conduit 22 at its hub 24 to flow fluid to or from the cascade initiator 20. It is shown placed perpendicular to the crossbar hub 24. The terminal opening 21 to the conduit 36 serves as the inlet of the cascade 32, and fluid is supplied to the cascade 32 through this inlet 21 in the direction indicated by the arrow I.

A smaller scale second generation structure, generally 42, is configured from crossbar and leg conduits corresponding in number and arrangement to those of the initiator 20. In the specific embodiment illustrated, the second generation structure 42 is constructed to a scale which is a 50% reduction of the scale of the initiator. The still smaller scale third generation structure 46 is formed; e.g., by reducing the scale of the second generation structure 42 by 50%, in similar fashion. Reduction of scale by 50% for each subsequent scaling step (generation) insures that the density of outlets will be approximately equal throughout the volume regardless of the number of generations of scales added to the structure.

The crossbar 50 of each second generation structure 42 is placed transverse, typically normal, to and centered on one of the eight outlets 30 of the initiator 20. The crossbar 52 of each third generation structure 46 is similarly placed with respect to one of the outlets 54 of a second generation structure 42. Fluid flows freely from inlet 21 to the outlets 60 associated with the third generation structures 46.

FIG. 3 illustrates the continuing construction of the cascade 32, based upon the initiator 20 of FIG. 1, scaled through three generations. The fluid cascade is illustrated as being contained within fluid-containment vessel 61. When completed, eight copies of second generation structure 42 will be attached to the initiator 20, and eight copies of third generation structure 46 will be attached to each second generation structure 42 for a total of sixty four copies of third generation structure 46. The total number of outlets 60 will be 512. When completed, fluid flow will enter at inlet 21 and flow through 512 paths, approximately equally, to outlets 60. Fluid will exit outlets 60 into the volume within treatment zone 62 surrounding the device as indicated by arrows O. The forgoing description applies when cascade 32 is employed as a distribution cascade. The directions of flow is inherently be reversed when cascade 32 is used as a collection cascade. In that case, flow from the volume surrounding the device enters each of the 512 individual outlets (inlets in collection mode of operation) 60. Flow then continues through conduits comprising each initiator generation until exiting at inlet (outlet in collection mode of operation) 21.

The hydraulic path characteristics from inlet 21 to any outlet 60 are approximately equivalent. Through any path, conduit length is approximately equal, as are number and size of angle turns and conduit diameter at each scale. A more concise description of this property is that any path from inlet 21 to any specific outlet 60 can be generated from any other specific path from inlet 21 to a different outlet 60 by applying symmetry operations to the path. For example, by applying rotation or mirror operations on the cascade 32, every path can be shown to be the equivalent of every other path through the device.

Practical devices may be constructed with less path and scale symmetry than has been described in connection with the illustrated embodiment. For example, the fractal recursion of the cascade assembly may be interrupted as conduit is scaled down by incorporating a descendent generation conduit structure which departs from the configuration of the initiator. Descendant generation conduit structures may be scaled down by different percentages. The paths from the inlet to the outlets may exhibit a variance to symmetry operations by, for example, incorporating an unsymmetrical initiator. While such constructions are operable, they are generally not advantageous. A symmetrical system is generally easier to design and construct. Fluid flow control is easier to maintain when all of the available flow paths exhibit substantially identical hydraulic conditions.

FIG. 4 illustrates a completed cascade with four levels of scale. Compared with the cascade 32 illustrated by FIG. 3, an additional fourth generation conduit structure 64 has been added by reducing the third generation structure 46 of FIG. 3 by 50%. The crossbar 66 of the fourth generation conduit structure 64 is mounted with respect to the outlets 60 of the third generation conduit structures 46 in the same fashion as explained in connection with the parent, or ascendent, generation conduit structures. Fluid flows into inlet 21 as indicated by the arrow I, follows 4096 approximately hydraulically equivalent paths and exits into the volume surrounding the device through 4096 outlets 70.

An important characteristic of the preferred embodiment of this invention is the theoretically unlimited range for cascade scaling. This property is provided by the recursive nature of the cascade structure. Construction of the apparatus can continue in the same manner to add as many generations of reduced scale as desired to the device. With each additional descendant generation structure added, the density of outlets increases, resulting in increased mixing and distribution efficiency.

In practice, there are inevitable boundaries imposed upon ideal limitless scaling. One such boundary is associated with the recursive approach to complete space filling by the terminal outlets, e. g. 70. Because the conduit itself occupies a portion of the available space, as more generations of scale-down conduit structures are added, and the density of outlets increase, some of the descendant conduits will inevitably overlap larger scale conduit. This circumstance will typically first occur around the largest conduit, e.g., the center conduit 32 of FIG. 3. When crowding of this nature occurs, a practical expedient is selectively to block off those larger scale outlets in the crowded regions of the cascade which cannot, because of their location, receive smaller scale structures. Addition of smaller structure to the cascade can continue, following this procedure, until the contained volume is filled with outlets of the smallest scale conduit structure in the cascade.

A second boundary on the scaling approach of this invention is imposed by the practical availability of building materials and techniques. For applications larger than about 2–3 mm conduit diameter, standard building materials, such as pipe, tubing and molded or machined conduit are suitable for the construction of a cascade assembly of this invention by conventional methods. It is recognized, however, that because of the complex geometry of a cascade assembly of this invention, conventional construction techniques are less suitable for constructing conduit structures requiring very small (e.g., less than about 2–3 mm diameter) conduits. Computer-aided construction techniques are currently recommended for constructing such small devices. One example of such a practical technique is stereolithography. In the process of stereolithography a three dimensional CAD drawing is converted to a three dimensional object by exposing a vat of liquid plastic or epoxy resin to a computer controlled laser generated ultraviolet light. At the present time, objects can be constructed using this technique with total volume dimensions as large as about 500 mm×500 mm×500 mm. The minimum feature size which can be produced by such equipment is currently about 0.2–0.3 mm in X and Y and 0.1 mm in Z (Cartesian coordinate axes). Because the resulting three dimensional object is grown from a vat of liquid rather than constructed of parts, extremely complicated, detailed and small three dimensional geometry can be easily realized. Such a construction method is therefore practical for this invention when very small structure is desired.

Different construction techniques may be applicable for constructing conduit structures at any given scale. A single cascade device may consist of conduit structures constructed by different methods to accommodate different scales.

Figure 6:
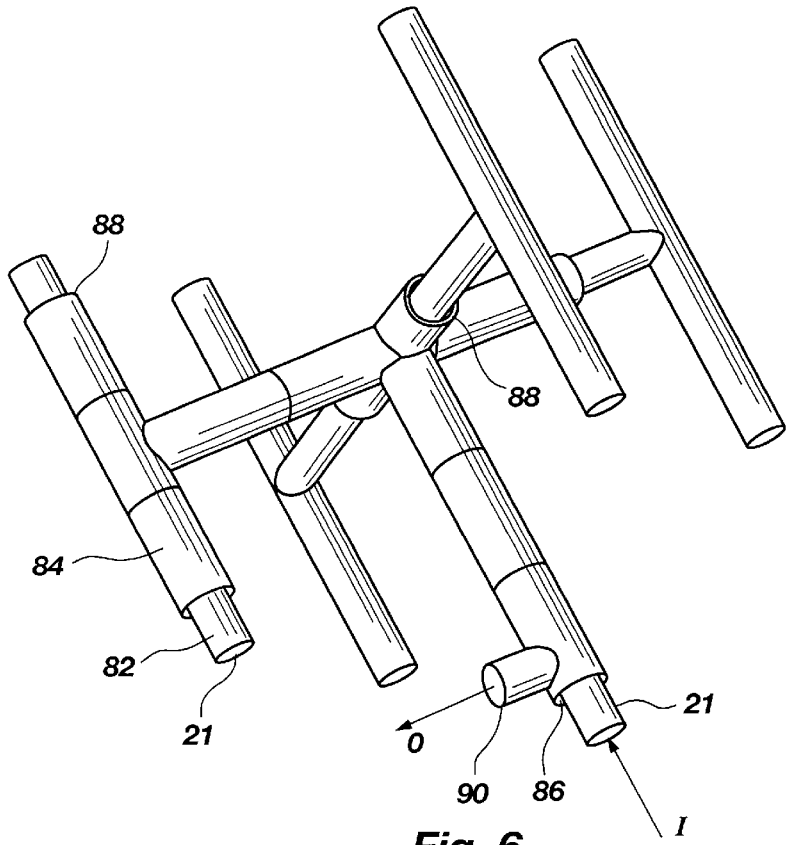
FIG. 6 is an isometric view of an alternative construction having capabilities similar to those of the construction illustrated by FIG. 5.
Figure 5:
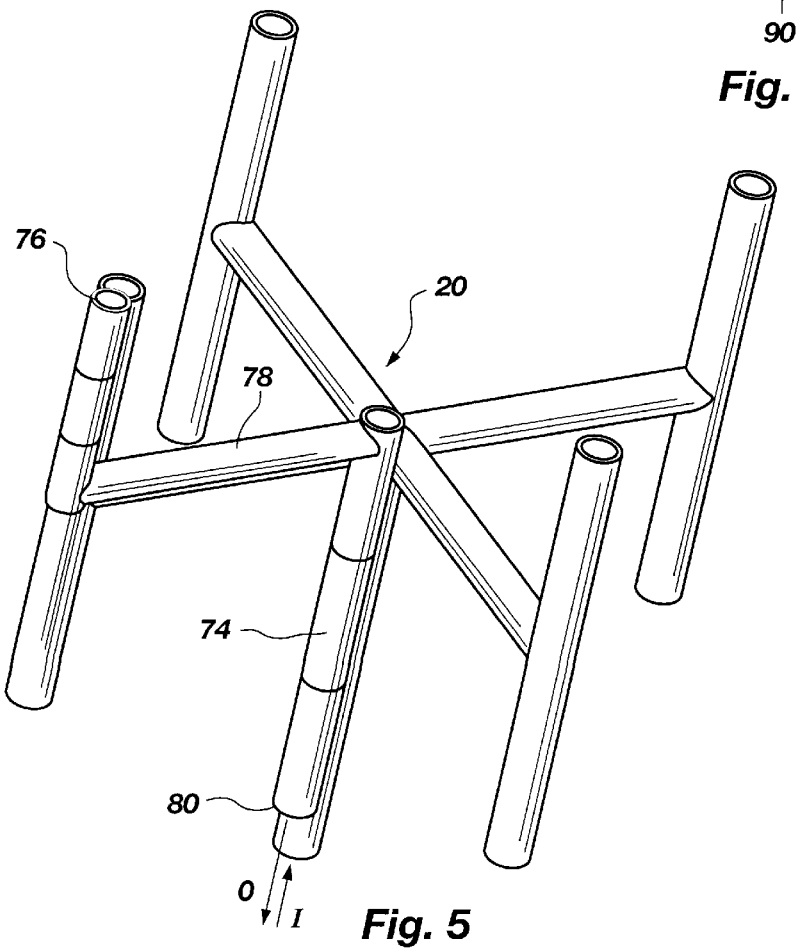
FIG. 5 is an isometric view of an artificial eddy cascade construction which allows for passage of multiple isolated fluids and/or multiple direction of fluid flow.

A particularly advantageous application of this invention is to utilize a cascade structure both as an input device and as a discharge or collection device. A pair of space filling cascades may be arranged to intertwine with one another within a single volume. FIGS. 5, 6 and 7*b* illustrate three alternative configurations for accomplishing this objective. FIG. 5 illustrates the initiator portions, generally 20 and 74, of an arrangement by which a second cascade structure is set closely adjacent and offset from a first such structure. This approach allows both cascade assemblies to be constructed by similar techniques. The first cascade assembly may be as illustrated by FIG. 3, with inlet 21 leading through conduit 36 to a cascade initiator 20. Fluid flow is into inlet 21, as indicated by the arrow I. The second cascade is constructed adjacent to the first, but offset in the x, y, and z Cartesian directions such that the second cascade substantially "hugs" the first cascade. The open terminal end 76 of the initiator 74 functions as an inlet. Fluid flows through conduit 78 in the direction indicated by the arrow O, and exits through outlet 80.

FIG. 6 illustrates an alternative cascade arrangement which provides for simultaneous distribution and collection. In this embodiment, a first conduit structure 82 is positioned concentrically within a second conduit structure 84. A first cascade, which includes the conduit 82, may be constructed as described with reference to FIG. 3 such that fluid enters at inlet 21 in the direction shown by arrow I. The annular space 86 remaining between the conduit structures including conduits 82 and 84, respectively, serves as the travel path for a second fluid. For example, fluid may enter at inlets 88, flow through the annular space 86 and exit through the outlet 90 in the direction shown by arrow O.

Figure 7A:
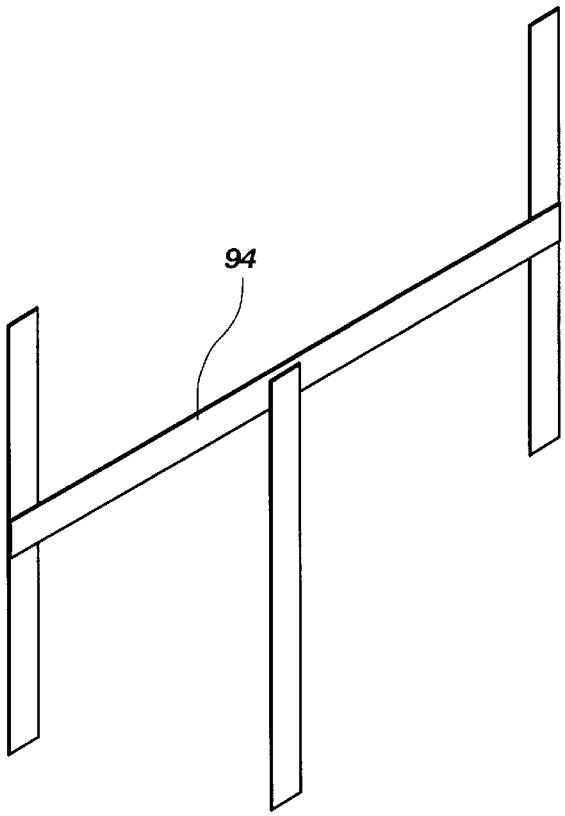
FIG. 7*a*, a pictorial view of a partition component.
Figure 7B:
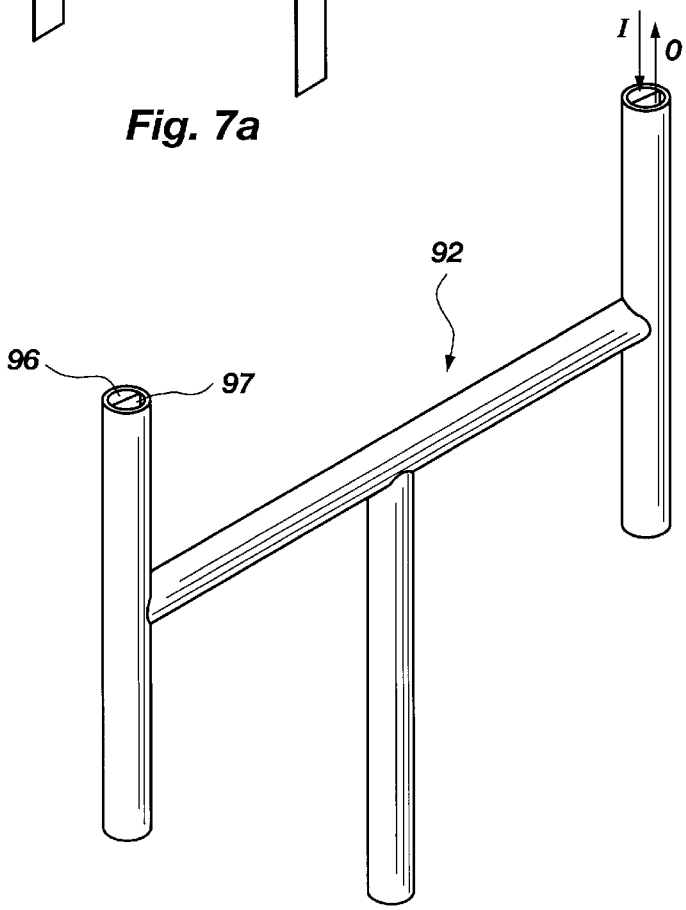
FIG. 7*b*, a pictorial view of an alternative construction similar in purpose to those of FIGS. 5 and 6, showing the component of FIG. 7*a* in assembled condition.

FIG. 7 illustrates a construction in which the conduits of a conduit structure, generally 92, are divided by a partition component 94 to create channels 96, 97 which allow for multiple isolated flow. A first fluid may travel in the direction of Arrow I through channel 96, while a second fluid travels through channel 97 in the direction of arrow O.

It is generally recommended that the distribution outlets and collection inlets of the distribution/collection arrangements of FIGS. 5 through 7*b* be offset from one another to ensure adequate treatment within the adjacent inter-spatial volume. Unit operations, such as ion exchange, require very short contact times. Fluids injected through closely spaced outlets thus require little residence time for effective treatment of the small volume assigned to each outlet. Nevertheless, it is normally useful to avoid short circuiting between inlet and outlet pairs.

The alternative embodiments for accommodating multiple flow paths permit the use of different construction techniques for different generations of conduit structures. The adjacent or concentric arrangements may be most practical for conduit sizes greater than about 2–3 mm, while the partitioned conduit arrangement may be more appropriate for use with computer aided construction techniques such as stereolithography.

It is noted that besides allowing operation as a distributor/collector, multiple paths can be used alternatively to distribute more than one component while keeping the components isolated from one another prior to outlet distribution/mixing.

Because devices of this invention are expected to be used for distribution/mixing within fluid processes, it is anticipated that conventional fluid distributor terminating equipment will normally be incorporated on the outlet/inlet ends of such a device. For example, nozzles, screened pipe holes or check valves can be relied upon in conventional fashion to prevent a sorption material from entering the cascade, provide a final distribution pattern or prevent back flow.

EXAMPLE 1

This example illustrates the turbulence reducing effect provided by structures of this invention and how this effect can be manipulated by the design of the cascade. The relationship describing the Reynolds number for smooth walled conduit is given by:

$$Re=VD\rho/\mu$$

where:

Re=the Reynolds number, a measure of turbulence

V=velocity through the conduit

D=conduit diameter $\rho$=fluid density $\mu$=fluid viscosity

Figure 8:
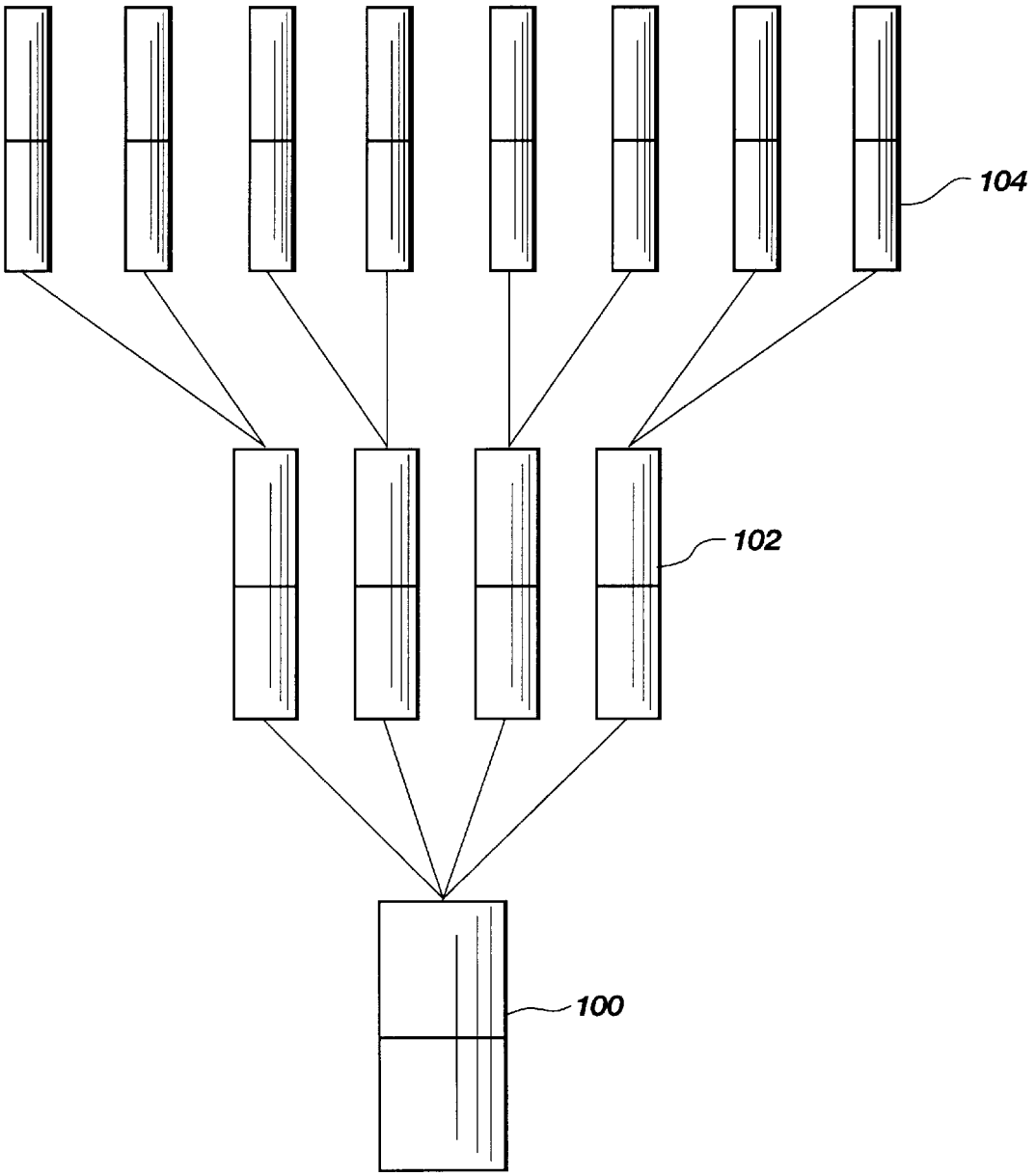
FIG. 8 is an exploded view in elevation, illustrating a disconnected branching cascade.

For this specific example, consider the disconnected conduit cascade in FIG. 8 wherein an initial fluid conduit 100 with diameter $D_1$ and cross sectional area $A_1$ branches into four smaller conduits 102. Each individual conduit 102 has diameter $D_2$ and cross sectional area $A_2$ and:

$$4\times A_2=A_1$$

Each conduit 102 branches into two conduits 104. Each of the conduits 104 has diameter $D_3$ and cross sectional area $A_3$ and:

$$2\times A_3=A_2$$

$$8\times A_3=A_1$$

Under these particular conditions, the velocity of a fluid through the cascade is constant in all conduits regardless of size, because the sum of the total cross sectional area at any scale is equal to the cross sectional area of the initial fluid conduit. For a given fluid, $\rho$ and $\mu$ are also constant so that the Reynolds number through each conduit is:

$$Re_1=kD_1$$

$$Re_2=kD_2$$

$$Re_3=kD_3$$

where:

$k=V\rho/\mu$=constant

Because the diameter of the conduits, D, is decreasing with each branch, the Reynolds number is also decreasing with each branch:

$$Re_3<Re_2<Re_1$$

The turbulence therefore decreases in a determined manner through the cascade.

EXAMPLE 2

This example determines absolute values for the decrease in Reynolds number for the cascade in example 1 considering a specific fluid under specific conditions:

Fluid=water

Temperature=40° C.

$\rho$=992.2 kg/m$^3$ $\mu$=0.656×10$^{-3}$N×s/m$^2$ $V$=0.07m/s $D_1$=50mm

For the conduit layout of example 1 the conduit cross sectional area relationships are:

$A_2=A_1/4$ $A_3=A_1/8$ or expressed as conduit diameters:

$(D_2\hat{}2)=(D_1\hat{}2)/4$ $(D_3\hat{}2)=(D_1\hat{}2)/8$ so:

$D_2$=25mm $D_3$=17.68mm

Then the decrease in Reynolds number through the cascade is:

$Re_1$=5294

$Re_2$=2647

$Re_3$=1872

Note that these examples only consider two branch points; that is three generations of conduit structures. The device illustrated by FIG. 4 has seven branches, and embodiments having many more branches are within contemplation. It should be clear that considerable reduction of turbulence can be designed into a device.

Those skilled in the art can readily apply the method of calculation followed in the examples to instances of specific fluids, conduit diameter, number of branches per node and variable velocity through the conduits. Those skilled in the art can also modify the examples to incorporate a target turbulence reduction and a target space filling density into the construction of a given device.

The non-turbulent mixing of this invention can be used to advantage in conjunction with conventional inter-fluid turbulence. For example, the homogeneous, space filling distribution provided by a cascade assembly of this invention can provide an advantageous first stage prior to final mechanical turbulent mixing. Additionally, the device can be used concurrently with a turbulent operation. For example, the device can be placed in motion (causing turbulence) while concurrently distributing fluid through the cascade and/or a fluid can be caused continuously to flow through the void volume space around the device while the device operates.

Using the methods disclosed, the device can be purposely designed to make use of residual turbulence exiting the outlets of the cascade. Fluid flow and device sizing can be calculated such that residual outlet turbulence is available to finalize mixing or distribution within small homogeneous sections of volume. This use of turbulence can be of benefit if scaling depth reaches a practical construction limit or if some jetting is desired, e.g., for aerator or scrubber type applications.

The present invention is directed to a mixing method which substitutes for inter-fluid turbulence. As a consequence, it can be used for mixing, turbulence dampening and space filling distribution/collection. Changes may be made to the embodiments described in this disclosure without departing from the broad inventive concepts they illustrate. Accordingly, this invention is not limited to the particular embodiments disclosed, but is intended to cover all modifications that are within the scope of the invention as defined by the appended claims.

What is claimed is:

1. A fluid scaling cascade of branching conduits, comprising:

a largest scale conduit at a first end of said fluid scaling cascade; and a plurality of smallest scale conduits at a second end of said fluid scaling cascade;

said largest scale conduit being connected by successive divisions at corresponding successive branches to said smallest scale conduits;

said smallest scale conduits being of smaller diameter than said largest scale conduit;

whereby fluid flowing through the cascade from the large scale end to the small scale end of the cascade is progressively scaled into smaller units of flow so that fluid flowing through the cascade from the large scale end to the small scale end of the cascade exits approximately homogeneously into a volume containing said fluid scaling cascade; and said fluid scaling cascade is further characterized by fractal structure wherein an initiator conduit structure configuration is repeated on successively smaller scales through a plurality of descendent generations, wherein said initiator conduit structure includes:

an inlet in fluid communication with a hub; and a plurality of first generation distribution conduits which radiate as spokes from said hub; and said first generation distribution conduits each terminate in a pair of oppositely directed outlets, each of which is structurally connected in fluid communication to an inlet of a second generation conduit structure; and said first generation distribution conduits define a cross with four approximately hydraulically equivalent spokes; and said initiator conduit structure thereby includes eight outlets, said outlets being positioned, respectively, at the eight corners of an imaginary cube.

2. Apparatus comprising:

a vessel, defining a fluid-confining volume;

a fluid scaling cascade of branching conduits mounted within said vessel, said cascade including:

a largest scale conduit at a first, large scale, end of said cascade; and a plurality of smallest scale conduits at a second, small scale, end of said cascade;

said largest scale conduit being connected by successive divisions at corresponding successive branches to said smallest scale conduits;

said smallest scale conduits being of smaller diameter than said largest scale conduit;

said cascade being structured and arranged within said volume such that:

fluid flowing through said cascade from said large scale end to said small scale end of said cascade is progressively scaled into smaller units of flow, eventually to exit from said small scale end approximately homogeneously into said volume; and fluid flowing through said cascade from said small scale end to said large scale end of said cascade is progressively scaled into larger units of flow, whereby to collect fluid approximately homogeneously from said volume through said small scale end, eventually to exit from said large scale end, wherein:

said largest scale conduit is connected to said smallest scale conduits through a succession of conduits of decreasing scale corresponding to a plurality of descendent generations of progressively decreasing scale, wherein:

each generation of branching conduits is scaled to contain approximately the same volume of fluid as each other generation of conduits in said cascade, and said cascade including:

an initiator, constituting a first generation conduit structure, including an initiator inlet in open communication with a first generation set of distribution conduits, each of which terminates in one of a set of first generation outlets, said first generation inlet, communicating with a hub, and said first generation distribution conduits radiating as spokes from said hub; and a plurality of descendent generations of conduit structures, the individual conduit structures of which are configured approximately the same as said initiator, wherein:

said first generation distribution conduits define a cross with four approximately hydraulically equivalent spokes; and said initiator conduit structure thereby includes eight outlets, said outlets being positioned, respectively, at the eight corners of an imaginary cube.

3. An article of manufacture constructed for direct injection or withdrawal of a fluid in a space-filling distribution throughout a volume, comprising:

an initiator conduit structure, including an initiator inlet in open communication with a first generation set of distribution conduits, each of which terminates in open communication with one of a set of first generation outlets, said first generation outlets comprising a first population located on a first side of a first generation reference plane and a second population located on a second side of said first generation reference plane; and a second generation set of conduit structures equal in number to the number of outlets in said set of first generation outlets, each of said second generation conduit structures including a second generation inlet in open communication between one of said first generation outlets and a second generation set of distribution conduits, each of which terminates in open communication with one of a set of second generation outlets;

said second generation outlets associated with each of said second generation structures comprising a first population located on a first side of a second generation reference plane, and a second population located on a second side of said second generation reference plane;

wherein said initiator conduit structure comprises a configuration characterized by geometry requiring a component of fluid flow in each of the 3 Cartesian coordinate directions; and wherein said first generation set of distribution conduits lie in a unique plane oriented in space substantially perpendicular to the direction of fluid flow in said initiator inlet.

4. An article of manufacture according to claim 3, wherein the configuration of said second generation conduit structures is approximately the same, but to a reduced scale, as the configuration of said initiator conduit structure.

5. An article of manufacture according to claim 3, in combination with a vessel having an internal fluid-confining volume, said article of manufacture being positioned within said volume.

6. A combination according to claim 5, wherein:

said vessel includes a treatment zone constructed and arranged to contain a first fluid component; and said article of manufacture is constructed and arranged to position outlets substantially equally spaced throughout said zone.

7. An article of manufacture according to claim 3, wherein:

said first generation inlet communicates with a hub, and said first generation distribution conduits radiate as spokes from said hub.

8. An article of manufacture according to claim 7, wherein the configuration of said second generation conduit structures is approximately the same, but to a reduced scale, as the configuration of said initiator conduit structure such that the second generation distribution conduits of each said second generation conduit structure radiates as a spoke from a central second generation hub which is in fluid flow communication with a said first generation outlet.

9. An article of manufacture according to claim 3, characterized by fractal structure wherein the geometric configuration of said initiator conduit structure is repeated on successively smaller scales through a plurality of generations.

10. An article of manufacture according to claim 9, wherein:

said first generation inlet communicates with a hub, and said first generation distribution conduits radiate as spokes from said hub.

11. An article of manufacture according to claim 10, wherein the second generation distribution conduits of each said second generation conduit structure radiates as a spoke from a central second generation hub which is in fluid flow communication with a said first generation outlet.

12. A fluid scaling cascade comprising:

a largest scale conduit at a first end of said cascade; and a plurality of smallest scale conduits at a second end of said cascade;

said largest scale conduit being connected by successive divisions at corresponding successive branches to said smallest scale conduits;

said smallest scale conduits being of smaller diameter than said largest scale conduit;

whereby fluid flowing through the cascade from the large scale end to the small scale end of the cascade is progressively scaled into smaller units of flow;

so that fluid flowing through the cascade from the large scale end to the small scale end of the cascade exits in a space filling distribution into a volume containing said cascade wherein:

said cascade is characterized by fractal structure wherein an initiator conduit structure configuration is repeated on successively smaller scales through a plurality of descendent generations, and said initiator conduit structure comprises conduit paths oriented such that a component exists, for each of the 3 Cartesian coordinate axis directions, of some conduit path in combination through said initiator conduit structure.

13. A fluid scaling cascade according to claim 12, wherein:

said initiator conduit structure includes:

an inlet in fluid communication with a hub; and a plurality of first generation distribution conduits which radiate as spokes from said hub.

14. A fluid scaling cascade according to claim 13, wherein said first generation distribution conduits each terminate in a pair of oppositely directed outlets, each of which is structurally connected in fluid communication to an inlet of a second generation conduit structure.

15. A fluid scaling cascade according to claim 14, wherein the path from said initiator inlet to any of said second generation outlets is substantially similar hydraulically.

16. A fluid scaling cascade of branching conduits comprising:

a largest scale conduit at a first end of said cascade; and a plurality of smallest scale conduits at a second end of said cascade;

said largest scale conduit being connected by successive divisions at corresponding successive branches to said smallest scale conduits;

each of said divisions comprising a right angle intersection of a supply conduit with a plurality of distributor conduits;

said smallest scale conduits being of smaller diameter than said largest scale conduit; whereby fluid flowing through the cascade from the large scale end to the small scale end of the cascade is progressively scaled into smaller units of flow; so that fluid flowing through the cascade from the large scale end to the small scale end of the cascade exits approximately homogeneously into a volume containing said cascade;

said fluid scaling cascade having an initiator conduit structure configuration repeated through a plurality of descendent generations, and characterized by fractal structure wherein an initiator conduit structure configuration is repeated on successively smaller scales through a plurality of descendent generations; wherein:

said initiator conduit structure includes:

an inlet in fluid communication with a hub; and a plurality of first generation distribution conduits which radiate as spokes from said hub; wherein said first generation distribution conduits each terminate in a pair of oppositely directed outlets, each of which is structurally connected in fluid communication to an inlet of a second generation conduit structure; and said first generation distribution conduits define a star with three approximately hydraulically equivalent spokes; and said initiator conduit structure thereby includes six outlets, said outlets being positioned, respectively, at the six corners of an imaginary triangular block.

17. An article of manufacture comprising:

a vessel, defining a fluid-confining volume;

a fluid scaling cascade of branching conduits mounted within said vessel, said cascade including:

a largest scale conduit at a first, large scale, end of said cascade;

a plurality of smallest scale conduits at a second, small scale, end of said cascade;

said largest scale conduit being connected by successive divisions at corresponding successive branches to said smallest scale conduits;

said smallest scale conduits being of smaller diameter than said largest scale conduit;

said cascade being structured and arranged within said volume such that:

fluid flowing through said cascade from said large scale end to said small scale end of said cascade is progressively scaled into smaller units of flow, eventually to exit from said small scale end in a space filling distribution into said volume; and fluid flowing through said cascade from said small scale end to said large scale end of said cascade is progressively scaled into larger units of flow, whereby to collect fluid from a space filling distribution within said volume through said small scale end, eventually to exit from said large scale end, said largest scale conduit is connected to said smallest scale conduits through a succession of conduits of decreasing scale corresponding to a plurality of descendent generations of progressively decreasing scale, each generation of branching conduits is scaled to contain in summation approximately the same cross-section area as each other generation of conduits in said cascade, and an initiator, constituting a first generation conduit structure, including an initiator inlet in open communication with a first generation set of distribution conduits, each of which terminates in one of a set of first generation outlets, said first generation inlet, communicating with a hub, and said first generation distribution conduits radiating as spokes from said hub; and a plurality of descendent generations of conduit structures, the individual conduit structures of which are configured approximately the same as said initiator.

* * * * *